US010030669B2

(12) United States Patent
Sezal et al.

(10) Patent No.: US 10,030,669 B2
(45) Date of Patent: Jul. 24, 2018

(54) APPARATUS FOR TRANSFERRING ENERGY BETWEEN A ROTATING ELEMENT AND FLUID

(71) Applicant: General Electric Company, Schenectady, NY (US)

(72) Inventors: Ismail Hakki Sezal, Munich (DE); Christian Aalburg, Munich (DE); Rajesh Kumar Venkata Gadamsetty, Bangalore (IN); Matthias Carl Lang, Munich (DE); Venkata Rama Krishna Chaitanya Ongole, Bangalore (IN); Alberto Scotti del Greco, Figline Valdarno (IT); Rudolf Konrad Selmeier, Fahrenzhausen (DE)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 414 days.

(21) Appl. No.: 14/315,405

(22) Filed: Jun. 26, 2014

(65) Prior Publication Data

US 2015/0377252 A1 Dec. 31, 2015

(51) Int. Cl.
*F04D 29/46* (2006.01)
*F04D 17/08* (2006.01)
(Continued)

(52) U.S. Cl.
CPC ..... *F04D 29/462* (2013.01); *F04D 17/08* (2013.01); *F04D 29/4213* (2013.01); *F04D 29/667* (2013.01)

(58) Field of Classification Search
CPC ..... F01D 17/14; F01D 17/141; F01D 17/143; F01D 17/146; F01D 17/16; F01D 17/167;
(Continued)

(56) References Cited

U.S. PATENT DOCUMENTS 3,354,643 A * 11/1967 Paredes ..... F16H 41/26 60/354
3,957,392 A 5/1976 Blackburn
(Continued)

FOREIGN PATENT DOCUMENTS

DE 3844189 A1 7/1990
GB 530149 A * 12/1940 ..... F04D 29/462
(Continued)

OTHER PUBLICATIONS

Machine Translation of JPH 0893691 [retrieved on Feb. 9, 2017]. Retrieved from: Espacenet.*
(Continued)

*Primary Examiner* — Igor Kershteyn
*Assistant Examiner* — Eric Zamora Alvarez
(74) *Attorney, Agent, or Firm* — GE Global Patent Operation; Pabitra Chakrabarti

(57) ABSTRACT

Embodiments of an apparatus for transferring energy between a rotating element and a fluid are provided herein. In some embodiments, a plenum of an apparatus for transferring energy between a rotating element and a fluid may include a through hole disposed through the plenum; and a plurality of inlet guide vanes disposed proximate a peripheral edge of the through hole, the plurality of inlet guide vanes comprising a first group of inlet guide vanes having a cambered profile and a second group of inlet guide vanes disposed radially inward of the first group of inlet guide vanes, wherein the first group of inlet guide vanes are in a fixed position with respect to the plenum and the second group of inlet guide vanes are movable with respect to the plenum.

16 Claims, 4 Drawing Sheets

(51) Int. Cl.
*F04D 29/42* (2006.01)
*F04D 29/06* (2006.01)
*F04D 29/66* (2006.01)

(58) Field of Classification Search
CPC ..... F01D 17/165; F04D 29/46; F04D 29/44; F04D 29/42; F04D 29/462; F04D 29/464; F04D 17/08; F04D 17/10; F04D 29/4213; F04D 29/667
See application file for complete search history.

(56) References Cited

U.S. PATENT DOCUMENTS 3,992,128 A * 11/1976 Lunsford ..... F04D 29/462 415/161
4,012,908 A * 3/1977 Dundore ..... F16H 61/56 415/161
4,013,378 A * 3/1977 Herzog ..... F01D 25/30 415/208.2
4,436,481 A * 3/1984 Linder ..... F02C 7/045 138/37
4,439,104 A * 3/1984 Edmonds ..... F02C 7/045 181/213
4,531,356 A 7/1985 Linder
4,705,452 A * 11/1987 Karadimas ..... F01D 17/162 415/115
4,737,071 A 4/1988 Horn, Jr.
4,740,138 A 4/1988 Zaehring et al.
4,752,182 A 6/1988 Zaehring et al.
5,165,849 A 11/1992 Nakagawa et al.
5,417,547 A 5/1995 Harada
5,460,484 A 10/1995 Yagi
5,851,103 A 12/1998 Harada et al.
7,186,077 B2 * 3/2007 Daudel ..... F01D 17/165 415/164
7,520,716 B2 4/2009 Tacconelli et al.
7,824,148 B2 11/2010 Tetu et al.
8,079,808 B2 12/2011 Sconfietti
2005/0123397 A1 * 6/2005 McArdle ..... F01D 17/165 415/196
2008/0050228 A1 2/2008 Chen et al.
2010/0150701 A1 6/2010 Simon et al.
2012/0263586 A1 10/2012 Patil
2013/0315718 A1 * 11/2013 Parker ..... F02B 37/22 415/157

FOREIGN PATENT DOCUMENTS

GB 545858 A * 6/1942 ..... F04D 29/462
GB 2426555 A 11/2006
JP 08093691 A * 4/1996 ..... F04D 29/4213

OTHER PUBLICATIONS

Meherwan P. Boyce, "Centrifugal Compressors", Gas Turbine Engineering Handbook (Third Edition), 2006, pp. 219-273.
PCT Search Report and Written Opinion issued in connection with corresponding Application No. PCT/US2015/37321 dated Sep. 7, 2015.

* cited by examiner

APPARATUS FOR TRANSFERRING ENERGY BETWEEN A ROTATING ELEMENT AND FLUID

BACKGROUND

The subject matter disclosed herein generally relates to apparatus for transferring energy between a rotating element and fluid, and more specifically to turbomachinery, for example, centrifugal compressors.

Conventional turbomachinery, for example centrifugal compressors, generally include a plenum configured to direct a working gas (e.g., air, natural gases, hydrocarbons, carbon dioxide, or the like) from an inlet to one or more impellers to facilitate transferring energy from the impellers to the working gas. To direct the flow of the working gas through the plenum and towards the impellers in a desired flow path, a number of inlet guide vanes are disposed symmetrically within the plenum. In some variations, to correct an inlet swirl to the compressor caused by a variation in mass flow each of the inlet guide vanes may be rotated about its axis, thereby improving operation. However, the inventors have observed that such configurations of the inlet guide vanes introduce losses into the plenum, thereby negatively affecting compressor performance and reducing efficiency of the compressor.

Therefore, the inventors have provided an improved apparatus for transferring energy between a rotating element and fluid.

SUMMARY

Embodiments of an apparatus for transferring energy between a rotating element and a fluid are provided herein.

In some embodiments, a plenum of an apparatus for transferring energy between a rotating element and a fluid may include a through hole disposed through the plenum; and a plurality of inlet guide vanes disposed proximate a peripheral edge of the through hole, the plurality of inlet guide vanes comprising a first group of inlet guide vanes having a cambered profile and a second group of inlet guide vanes disposed radially inward of the first group of inlet guide vanes, wherein the first group of inlet guide vanes are in a fixed position with respect to the plenum and the second group of inlet guide vanes are movable with respect to the plenum.

In some embodiments, an apparatus for transferring energy between a rotating element and a fluid may include an housing having an inlet to allow a flow of fluid into the housing; a plenum defining a flow path fluidly coupled to the inlet, the plenum having a through hole disposed through the plenum; a plurality of inlet guide vanes disposed proximate a peripheral edge of the through hole, the plurality of inlet guide vanes comprising a first group of inlet guide vanes having a cambered profile and a second group of inlet guide vanes disposed radially inward of the first group of inlet guide vanes, wherein the first group of inlet guide vanes are in a fixed position with respect to the plenum and the second group of inlet guide vanes are movable with respect to the plenum.

The foregoing and other features of embodiments of the present invention will be further understood with reference to the drawings and detailed description.

DESCRIPTION OF THE FIGURES

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of the invention and are therefore not to be considered limiting in scope, for the invention may admit to other equally effective embodiments.

To facilitate understanding, identical reference numbers have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of an apparatus for transferring energy between a rotating element and a fluid are provided herein. The inventive apparatus advantageously includes a plenum having a plurality of inlet guide vanes that reduces or eliminates losses in the plenum that would otherwise be caused by conventionally configured inlet guide vanes, thereby increasing the efficiency of the apparatus. While not intending to be limiting, the inventors have observed that the inventive apparatus may be particularly advantageous in applications including compressors, for example, such as centrifugal compressors.

Figure 1:
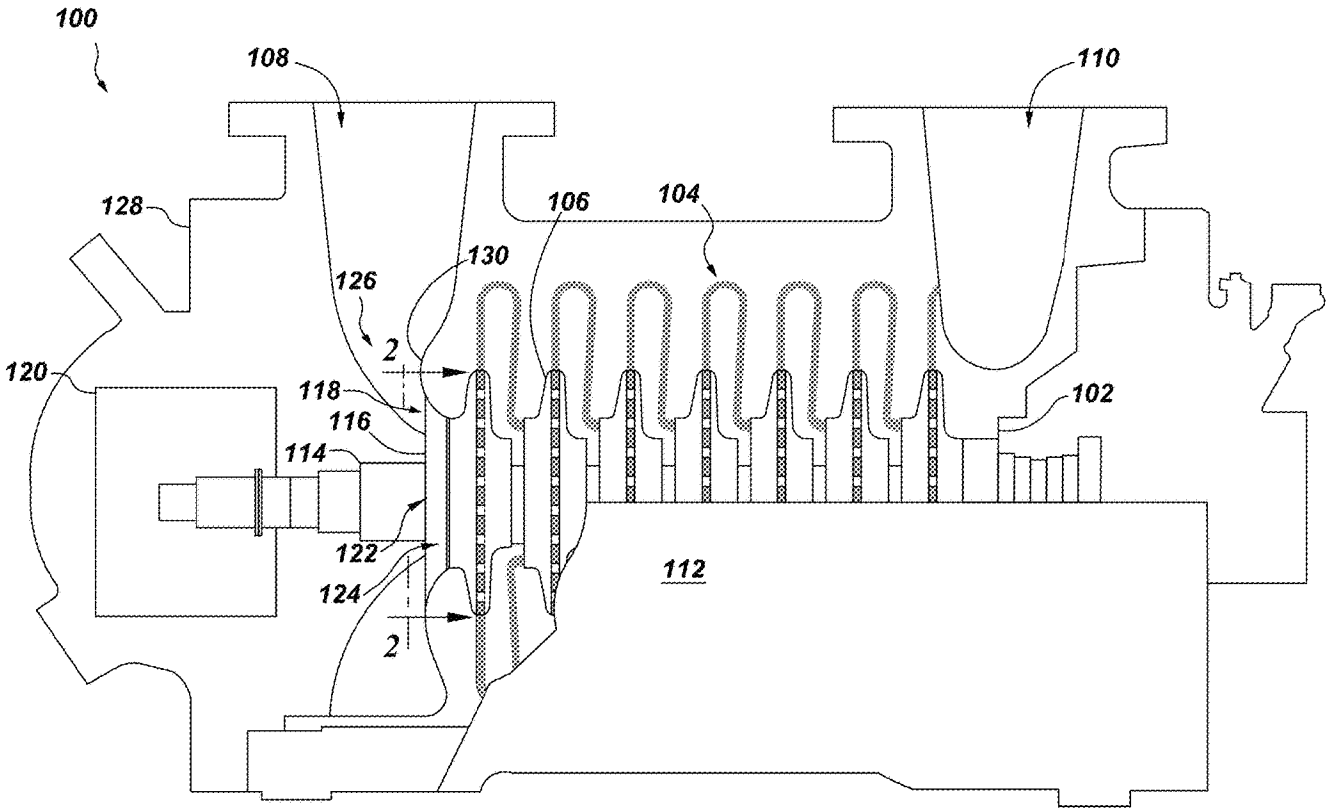
FIG. 1 is a partial cross sectional view of a portion of an exemplary apparatus for transferring energy between a rotating element and a fluid in accordance with some embodiments of the present invention.

FIG. 1 is a partial cross sectional view of a portion of an exemplary apparatus 100 for transferring energy between a rotating element and a fluid in accordance with some embodiments of the present invention. The apparatus 100 may be any apparatus suitable to facilitate a transfer of energy between a rotating element and a fluid, for example, a turbomachine such as a centrifugal compressor, or the like.

The apparatus (compressor) 100 generally comprises a body 128 defining an inner cavity 102, a plurality of flow paths 104, and an inlet 108 and outlet 110, wherein the inlet 108 and outlet 110 are fluidly coupled to the plurality of flow paths 104. A rotatable shaft 114 having a plurality of impellers 106 coupled thereto is disposed at least partially within the inner cavity 102. In some embodiments a housing (partially shown) 112 may be disposed about the body 128.

In some embodiments, the rotatable shaft 114 may be rotated within the inner cavity 102 via a motor 120. The motor 120 may be any type of motor suitable to rotate the rotatable shaft 114 at a desired speed, for example, an electric motor, hydraulic motor, combustion engine, or the like.

In some embodiments, a working gas (e.g., air, natural gases, hydrocarbons, carbon dioxide, or the like) is directed towards the impellers 106 via a plenum 118. The plenum 118 generally comprises an inlet 126 fluidly coupled to the inlet 108 of the body 128, a through hole 124 fluidly coupled to the inlet 126 and a curved inner surface 130 configured to direct the working gas from the inlet 126 towards the through hole 124. In some embodiments, the plenum 118 may be at least partially formed by the body 128, for example, such as shown in FIG. 1. In some embodiments, a ring 116 having a through hole 122 that is concentric to the through hole 124 of plenum 118 may be disposed within the plenum 118 to further facilitate the flow of the working gas from inlet 108 to the impellers 106 in a desired flow path.

In an exemplary operation of the compressor 100, the shaft 114 and impellers 106 may be rotated within the inner cavity 102 via the motor 120. The working gas is drawn into the inlet 108 of the body 128 via a suction force caused by the rotation of the impellers 106 and is directed to the impellers 106 via the plenum 118. The working gas is pressurized via a flow of the working gas through the impellers 106 and flow paths 104 and then discharged from the body 128 via the outlet 110.

The inventors have observed that conventional compressors typically include a number of symmetrical inlet guide vanes disposed within a plenum (e.g., the plenum 118 described above) to direct the flow of the working gas through the plenum and towards a plurality of impellers (e.g., the impellers 106 described above) in a desired flow path. In some variations, to correct an inlet swirl to the compressor caused by a variation in mass flow, each of the inlet guide vanes may be rotated about a central axis of the inlet guide vane, thereby potentially improving operation. However, the inventors have observed that such configurations of the inlet guide vanes introduce losses into the plenum, thereby negatively affecting compressor performance and reducing efficiency of the compressor.

Figure 2:
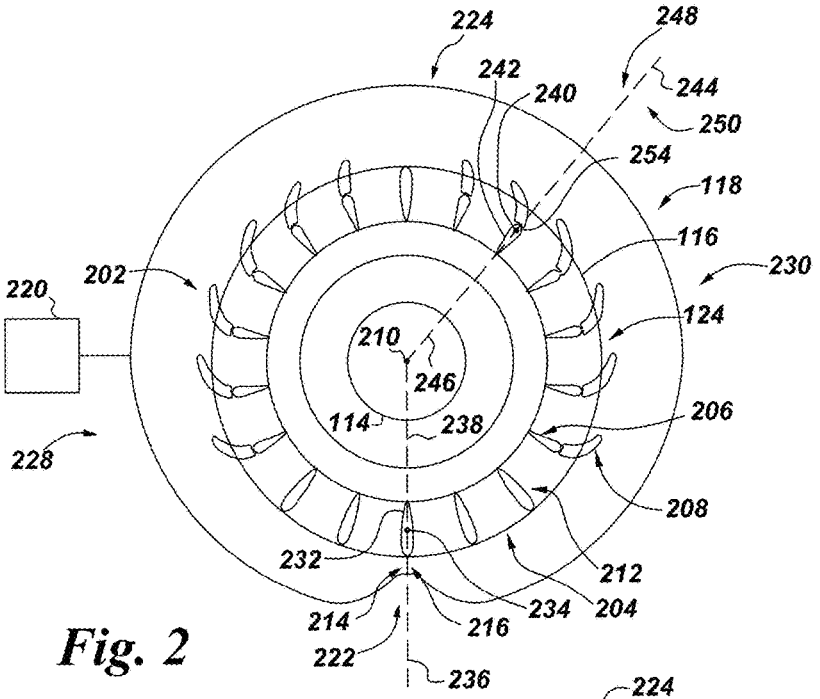
FIG. 2 depicts a portion of the apparatus of FIG. 1 with respect to the line 2-2 of FIG. 1 in accordance with some embodiments of the present invention.

As such, referring to FIG. 2, in some embodiments, the plenum 118 comprises a plurality of inlet guide vanes 202 disposed proximate a peripheral edge 204 of the through hole 124. In some embodiments, the plurality of inlet guide vanes 202 generally comprise a first group 208 of inlet guide vanes having a cambered profile and a second group 206 of inlet guide vanes disposed radially inward of the first group 208 of inlet guide vanes. In such embodiments, the first group 208 of inlet guide vanes are in a fixed position with respect to the plenum 118 and the second group 206 of inlet guide vanes are movable with respect to the plenum 118. The inventors have observed that by configuring the plurality of inlet guide vanes 202 as provided herein, losses in the plenum 118 that would otherwise be caused by conventionally configured inlet guide vanes (e.g., as described above) may be reduced or eliminated, thereby increasing the efficiency of the compressor.

The plurality of inlet guide vanes 202 may be disposed about the plenum 118 with respect to one another and with respect to the peripheral edge 204 of the through hole 124 in any manner suitable to maximize flow of the working gas and reduce losses in the plenum. In some embodiments, the placement and orientation of the plurality of inlet guide vanes 202 may be dependent on an angle of the flow of the working gas entering the plenum 118 at various positions about the plenum 118. For example, in some embodiments, each of the plurality of inlet guide vanes 202 may be disposed substantially equidistant from one another about the plenum 118, such as shown in FIG. 2.

The first group 208 and second group 206 of inlet guide vanes 202 may be disposed about the plenum 118 in any manner suitable to maximize flow of the working gas and reduce losses in the plenum. For example, in some embodiments, one or more inlet guide vanes of the first group 208 and second group 206 may be disposed on a first side 228 of the plenum 118 and one or more inlet guide vanes of the first group 208 and the second group 206 may be disposed on a second side 230 of the plenum 118 opposite the first side 228, for example, such as shown in FIG. 2.

Figure 3:
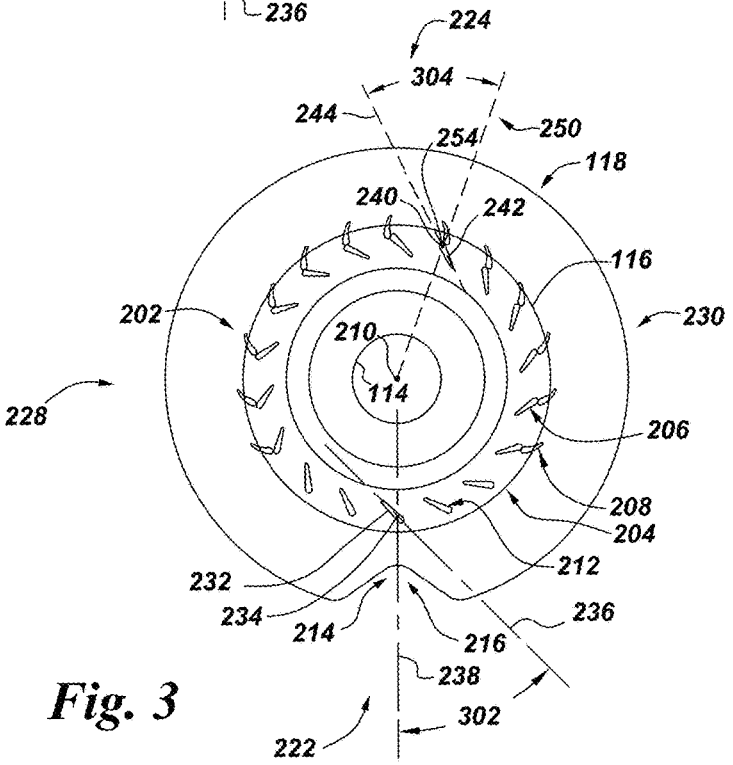
FIG. 3 depicts a portion of the apparatus of FIG. 1 with respect to the line 2-2 of FIG. 1 in accordance with some embodiments of the present invention.

Each inlet guide vane of the first group 208 may comprise any size and shape suitable to maximize flow of the working gas and reduce losses in the plenum 118. For example, in some embodiments, each inlet guide vane of the first group 208 may comprise a cambered profile, for example, such as shown in FIGS. 2 and 3, and described below with respect to FIGS. 6 and 7. The inlet guide vanes of the first group 208 may have the same size and shape, or alternatively, in some embodiments the size and shape of the inlet guide vanes of the first group 208 may be varied.

The first group 208 of inlet guide vanes may be disposed in any position with respect to the peripheral edge 204 of the through hole 124 suitable to maximize flow of the working gas and reduce losses in the plenum 118. For example, in some embodiments, each of the inlet guide vanes of the first group 208 may be disposed such that at least a portion of the inlet guide vane is disposed on the ring 116 and extends radially outward beyond the peripheral edge 204 of the through hole 124, such as shown in FIGS. 2 and 3.

Each inlet guide vane of the second group 206 may comprise any size and shape suitable to maximize flow of the working gas and reduce losses in the plenum 118. For example, in some embodiments, each inlet guide vane of the second group 206 may comprise a symmetrical profile, for example, such as shown in FIGS. 2 and 3, and described below with respect to FIGS. 6 and 7. The inlet guide vanes of the second group 206 may have the same size and shape, or alternatively, in some embodiments may be varied.

In some embodiments, each of the second group 206 of inlet guide vanes may be rotatable about a rotation axis (pivot point) (rotation axis 240 of a single inlet guide vane 242 shown in the figure). Although only one rotation axis 240 is shown, it is to be understood that each of the second group 206 of inlet guide vanes has a rotation axis as described herein. The second group 206 of inlet guide vanes may be rotated via any mechanism suitable to rotate the guide vanes with a desired degree of accuracy, for example, such as a common actuator ring or the like.

The rotation axis 240 may be disposed at any location across the inlet guide vane 242 suitable to provide a desired rotation of the inlet guide vane 242. For example in some embodiments, the rotation axis 240 may be disposed on or proximate a chord line 244 of the inlet guide vane 242, and further, proximate a leading edge 254 of the inlet guide vane 242. In some embodiments, the rotation axis 240 of every inlet guide vane of the second group 206 of inlet guide vanes may be disposed at a same radius with respect to the plenum 118 to facilitate movement of the second group 206 of inlet guide vanes via a common mechanism.

The second group 206 of inlet guide vanes may be rotated at any rotation angle suitable to accommodate variations in mass flow, thereby facilitating efficient operation of the plenum 118 and thus, increasing the efficiency of the compressor. As defined herein, the angle of rotation may be defined by an angle between the chord line 244 of the inlet guide vane 242 and an axis 246 of the plenum 118 connecting the center 210 of the plenum 118 to the rotation axis 240 of the inlet guide vane 242. In some embodiments, the angle of rotation may be about −30 degrees to about 70 degrees. As used herein, a positive angle indicates the rotation of the inlet guide vane 242 away from a first side 248 of the axis 246 and a negative angle indicates rotation away from a second side 250 of the axis 246. For example, in FIG. 2, the chord line 244 of the inlet guide vane 242 and the axis 246 of the plenum 118 connecting the center 210 of the plenum 118 are aligned, thus having an angle of rotation of about zero. In another example, in FIG. 3, the inlet guide vane 242 is rotated away from the second side 250 of the axis 246, thus the angle of rotation 304 is between about zero and about −30. In any of the embodiments described above, all of the inlet guide vanes of the second group 206 of inlet guide vanes may be simultaneously rotated at the same angle of rotation 304, or alternatively may have varying angles of rotation.

In some embodiments, the second group 206 of inlet guide vanes may be moved, for example, via an actuator 220. When present, the actuator 220 may be any type of actuator suitable to facilitate movement of the second group 206 of inlet guide vanes, for example, a hydraulic actuator, pneumatic actuator, electric actuator, mechanical actuator, or the like. In some embodiments, the actuator may be used in conjunction with a common mechanism, for example, an actuator ring that is coupled to each of the second group 206 of inlet guide vanes to facilitate simultaneous movement of the second group 206 of inlet guide vanes with a desired degree of accuracy. Alternatively, in some embodiments, each of the second group 206 of inlet guide vanes may be moved individually.

In some embodiments, the plurality of inlet guide vanes 202 may further comprise a third group 212 of inlet guide vanes, for example, such as shown in FIGS. 2 and 3. The third group 212 of inlet guide vanes may be disposed about the plenum 118 in any manner suitable to maximize flow of the working gas and reduce losses in the plenum 118. For example, in some embodiments, one or more inlet guide vanes of the third group 212 of inlet guide vanes (e.g., one inlet guide vane such as shown in the figure) may be disposed proximate a top 224 of the plenum 118 and one or more inlet guide vanes (e.g., five inlet guide vanes such as shown in the figure) of the third group 212 of inlet guide vanes may be disposed proximate a bottom 222 of the plenum 118.

The third group 212 of inlet guide vanes may have any shape suitable to maximize flow of the working gas and reduce losses in the plenum 118. For example, in some embodiments, each inlet guide vane of the third group 212 of inlet guide vanes may have a symmetrical profile, such as shown in FIGS. 2 and 3 and described below with respect to FIGS. 4 and 5.

The third group 212 of inlet guide vanes may be disposed in any position with respect to the peripheral edge 204 of the through hole 124 suitable to maximize flow of the working gas and reduce losses in the plenum 118. For example, in some embodiments, the third group 212 of inlet guide vanes may be disposed on the ring 116, for example, such as shown in FIG. 1.

In some embodiments, each of the third group 212 of inlet guide vanes may be rotatable about a rotation axis (pivot point) (rotation axis 234 of a single inlet guide vane 232 shown in the figure). Although only one rotation axis 234 is shown, it is to be understood that each of the third group 212 of inlet guide vanes has a rotation axis as described herein. The third group 212 of inlet guide vanes may be rotated via any mechanism suitable to rotate the guide vanes with a desired degree of accuracy, for example, such as a common actuator ring or the like.

The rotation axis 234 may be disposed at any location across the inlet guide vane 232 suitable to provide a desired rotation of the inlet guide vane 232. For example in some embodiments, the rotation axis 234 may be disposed on or proximate a chord line 236 of the inlet guide vane 232, and further, on or proximate a geometric center of the inlet guide vane 232. In some embodiments, the rotation axis 234 of every inlet guide vane of the third group 212 of inlet guide vanes may be disposed at a same radius with respect to the plenum 118 to facilitate movement of the third group 212 of inlet guide vanes via a common mechanism.

The third group 212 of inlet guide vanes may be rotated at any rotation angle suitable to accommodate variations in mass flow, thereby facilitating efficient operation of the plenum 118 and thus, increasing the efficiency of the compressor. As defined herein, the angle of rotation may be defined by an angle between the chord line 236 of the inlet guide vane 232 and an axis 238 of the plenum 118 connecting the center 210 of the plenum 118 to the rotation axis 234 of the inlet guide vane 232. In some embodiments, the angle of rotation may be about −30 degrees to about 70 degrees. As used herein, a negative angle indicates the rotation of the inlet guide vane 232 away from a first side 214 of the axis 238 and a positive angle indicates rotation away from a second side 216 of the axis 238. For example, in FIG. 2, the chord line 236 of the inlet guide vane 232 and the axis 238 of the plenum 118 connecting the center 210 of the plenum 118 are aligned, thus having an angle of rotation of about zero. In another example, in FIG. 3, the inlet guide vane 232 is rotated away from the first side 214 of the axis 238, thus the angle of rotation 302 is between about zero and about −30. In any of the embodiments described above, all of the inlet guide vanes of the third group 212 of inlet guide vanes may be simultaneously rotated at the same angle of rotation 302, or alternatively may have varying angles of rotation.

Figure 4:
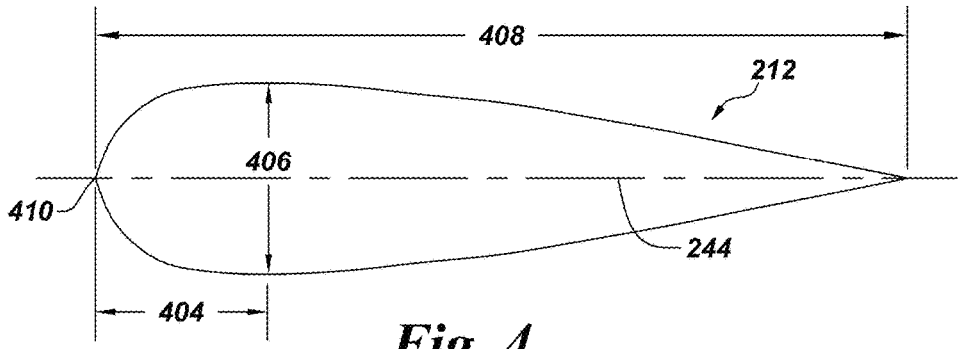
FIG. 4 is a side view of an exemplary inlet guide vane in accordance with some embodiments of the present invention.
Figure 5:
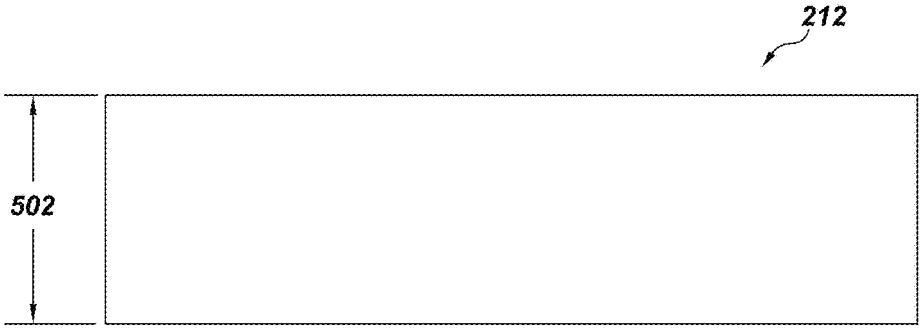
FIG. 5 is a top view of the exemplary inlet guide vane shown in FIG. 4 in accordance with some embodiments of the present invention.

Referring to FIG. 4, each inlet guide vane of the third group 212 of inlet guide vanes may have any dimensions suitable to maximize flow of the working gas and reduce losses in the plenum, while retaining a symmetrical profile. In some embodiments, the dimensions may be dictated by the size and shape of the plenum. For example, in some embodiments, each of the inlet guide vanes of third group 212 may have a length 408 and width (span) 502 (shown in FIG. 5) suitable to allow the inlet guide vanes to rotate without extending beyond an outer edge of the plenum ring (e.g., ring 116 described above). In some embodiments, the third group 212 of inlet guide vanes may have a maximum thickness 406 that is about 19% to about 25% of the length 408, wherein the maximum thickness 406 is located a distance 404 from the leading edge 410 of about 30% of the length 408. In some embodiments, each inlet guide vane of the third group 212 of the inlet guide vanes may have the same dimensions (e.g., width 502, length 408, maximum thickness 406, or the like).

Figure 6:
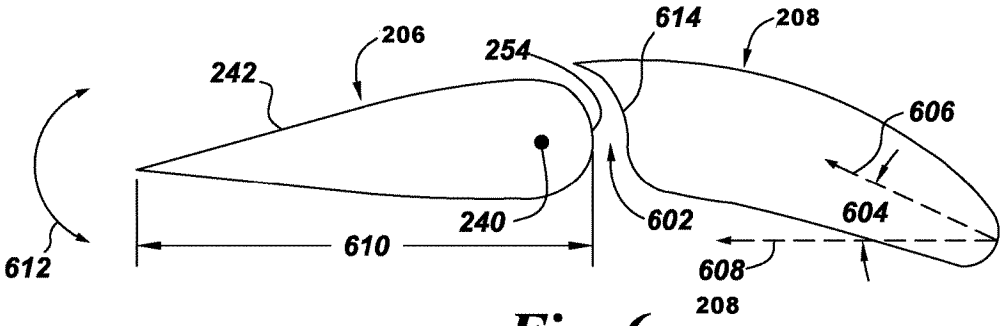
FIG. 6 is a side view of an exemplary inlet guide vane in accordance with some embodiments of the present invention.

Referring to FIG. 6, as discussed above, each inlet guide vane of the second group 206 of inlet guide vanes may be rotatable about a rotation axis 240 (movement of inlet guide vane 242 indicated at 612). In some embodiments, the each of the inlet guide vanes of the first group 208 may be spaced apart from a respective inlet guide vane of the second group 206, thereby forming a gap 602 between each of the inlet guide vanes of the first group 208 and second group 206. The gap 602 may be of any size and shape suitable to minimize entropy production and to enable a jet flow effect on a suction side of the rotatable inlet guide vane (e.g., inlet guide vane 242) to suppress or delay separation at high angle settings. In some embodiments, the size and shape of the gap 602 may be determined by the size and shape of each of the leading edge 254 of the second group 206 of inlet guide vanes and a trailing edge 614 of the first group 208 of inlet guide vanes.

Each inlet guide vane of the first group 208 and second group 206 may have any dimensions suitable to maximize flow of the working gas and reduce losses in the plenum. In some embodiments, the dimensions may be dictated by the size and shape of the plenum. For example, in some embodiments, each of the inlet guide vanes of second group 206 may have a length 610 and width (span) 702 (shown in FIG. 7) suitable to allow the inlet guide vanes to move about the rotation axis 240 without extending beyond an outer edge of the plenum ring (e.g., ring 116 described above). In another example, in some embodiments, each inlet guide vane of the second group 206 may have a length 610 that is about one half a width of the ring 116 of the plenum 118 (described above). In some embodiments, each inlet guide vane of the second group 206 may have a symmetrical profile (e.g., such as shown in FIG. 6), or alternatively, may have a cambered profile.

Each inlet guide vane of the first group 208 may have any cambered profile suitable to maximize flow of the working gas and may vary in accordance with placement of each inlet guide vane of the first group 208. For example, in some embodiments, a leading edge angle 604 (an angle between a tangential component 606 of the camber mean line and the chord line 608 of the inlet guide vane) may be determined by an incoming flow and may be varied at each location about the plenum 118. In such embodiments, the leading edge angle 604 may be about 30 degrees to about 80 degrees.

Figure 7:
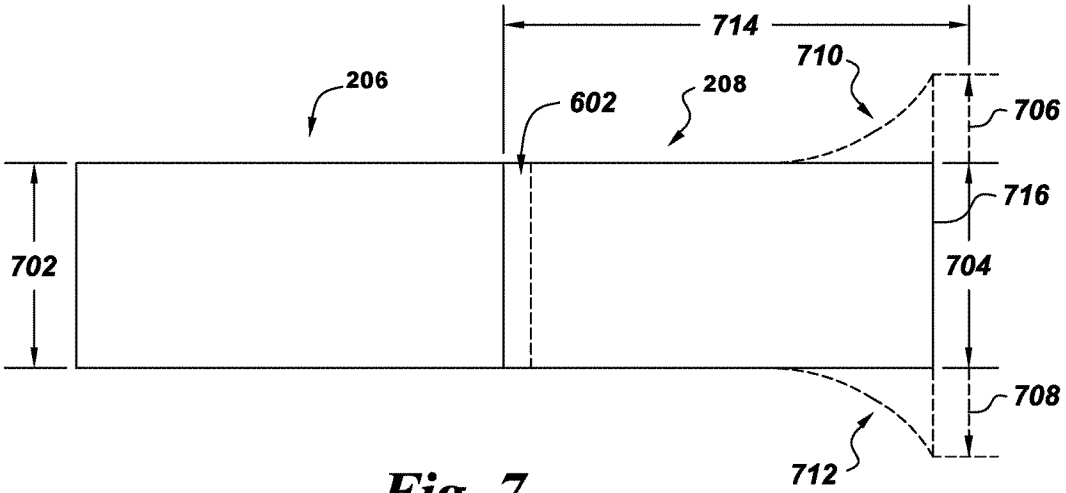
FIG. 7 is a top view of the exemplary inlet guide vane shown in FIG. 6 in accordance with some embodiments of the present invention.

Referring to FIG. 7, in some embodiments, each inlet guide vane of the first group 208 may have any length 714 suitable to allow a leading edge 716 of the inlet guide vane to extend beyond an edge of the plenum ring (e.g., such as shown in FIGS. 2 and 3) while maintaining the desired gap 602 between the inlet guide vanes. In addition, in some embodiments, each inlet guide vane of the first group 208 may have a width (span) 704 suitable to allow each inlet guide vane to conform to the surface of the plenum (e.g., surface 130 of plenum 118 described above) while extending towards an upstream flow direction of the plenum. In some embodiments, one or more of the inlet guide vanes of the first group 208 may have one or more flared portions (two flared portions 710 and 712 shown) to increase the width (span) 704 of the inlet guide vane to match one or more sidewalls at various locations of the plenum 118 (increased width shown in phantom at 706 and 708).

Thus, embodiments of an apparatus for transferring energy between a rotating element and a fluid have been provided herein. In at least one embodiment, the inventive apparatus advantageously reduces or eliminates losses in a plenum of the apparatus that would otherwise be caused by conventionally configured inlet guide vanes, thereby increasing the efficiency of the apparatus.

Ranges disclosed herein are inclusive and combinable (e.g., ranges of "about 30 degrees to about 80 degrees", is inclusive of the endpoints and all intermediate values of the ranges of "about 30 degrees to about 80 degrees", etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "some embodiments", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A plenum of an apparatus for transferring energy between a rotating element and a fluid, the plenum comprising:

a through hole disposed through the plenum; and a plurality of inlet guide vanes disposed radially proximate a peripheral edge of the through hole, the plurality of inlet guide vanes comprising:

a first group of inlet guide vanes, each inlet guide vane of the first group of inlet guide vanes is in a fixed position with respect to the plenum, has a cambered profile, is independently sized and configured, and has a length defined between a leading edge and a trailing edge that is greater than a maximum width defined between a top surface and a bottom surface;

a second group of inlet guide vanes disposed radially inward of the first group of inlet guide vanes, wherein each inlet guide vane of the second group of inlet guide vanes is movable with respect to the plenum and has a length defined between a leading edge and a trailing edge;

a third group of inlet guide vanes, wherein each inlet guide vane of the third group of inlet guide vanes has a symmetrical profile and is disposed proximate one of a top or a bottom of the through hole; and a ring disposed at least partially within the through hole, wherein the plurality of inlet guide vanes are coupled to the ring and wherein the first group of inlet guide vanes extend radially outward beyond an outer edge of the ring, wherein each of the inlet guide vanes of the first group is spaced apart from a respective inlet guide vane of the second group, thereby forming a gap between each trailing edge of the inlet guide vanes of the first group and the leading edge of the respective inlet guide vane of the second group, and wherein the gap is defined at a mid-length of a combined overall length of each of the inlet guide vanes of the first group and the respective inlet guide vane of the second group.

2. The plenum of claim 1, wherein a size and a shape of the gap is determined by a size and a shape of each of the leading edge of a respective inlet guide vane of the second group and the trailing edge of the respective inlet guide vane of the first group.

3. The plenum of claim 1, wherein the third group of inlet guide vanes are rotatable about a rotation axis.

4. The plenum of claim 1, wherein the second group of inlet guide vanes have a symmetrical profile.

5. The plenum of claim 1, wherein at least one of the first, group, of inlet guide vanes comprises a length that is different from another of the first group of inlet guide vanes.

6. The plenum of claim 1, wherein the second group of inlet guide vanes are movably coupled to the first group of inlet guide vanes.

7. The plenum of claim 1, wherein the plurality of inlet guide vanes are disposed symmetrically about the peripheral edge of the through hole.

8. The plenum of claim 1, wherein the apparatus is a centrifugal compressor.

9. An apparatus for transferring energy between a rotating element and a fluid, comprising:

a housing having an inlet to allow a flow of fluid into the housing;

a plenum defining a flow path fluidly coupled to the inlet, the plenum having a through hole disposed through the plenum; and a plurality of inlet guide vanes disposed radially proximate a peripheral edge of the through hole, the plurality of inlet guide vanes comprising:

a first group of inlet guide vanes, each inlet guide vane of the first group of inlet guide vanes is in a fixed position with respect to the plenum, has a cambered profile, is independently sized and configured, and has a length defined between a leading edge and a trailing edge that is greater than a maximum width defined between a top surface and a bottom surface;

a second group of inlet guide vanes disposed radially inward of the first group of inlet guide vanes, wherein each inlet guide vane of the second group of inlet guide vanes is movable with respect to the plenum and has a length defined between a leading edge and a trailing edge;

a third group of inlet guide vanes, wherein each inlet guide vane of the third group of inlet guide vanes has a symmetrical profile and is disposed proximate one of a top or a bottom of the through hole; and a ring disposed at least partially within the through hole, wherein the plurality of inlet guide vanes are coupled to the ring and wherein the first group of inlet guide vanes extend radially outward beyond an outer edge of the ring, wherein each of the inlet guide vanes of the first group is spaced apart from a respective inlet guide vane of the second group, thereby forming a gap between each trailing edge of the inlet guide vanes of the first group and the leading edge of the respective inlet guide vane of the second group, and wherein the gap is defined at a mid length of a combined overall length of each of the inlet guide vanes of the first group and the respective inlet guide vane of the second group.

10. The apparatus of claim 9, wherein a size and a shape of the gap is determined by a size and a shape of each of the leading edge of a respective inlet guide vane of the second group and the trailing edge of the respective inlet guide vane of the first group.

11. The apparatus of claim 9, wherein the third group of inlet guide vanes are rotatable about a rotation axis.

12. The apparatus of claim 9, wherein the second group of inlet guide vanes have a symmetrical profile.

13. The apparatus of claim 9, wherein at least one of the first group of inlet guide vanes comprises a length that is different from another of the first group of inlet guide vanes.

14. The apparatus of claim 9, wherein the second group of inlet guide vanes are movably coupled to the first group of inlet guide vanes.

15. The apparatus of claim 9, wherein the plurality of inlet guide vanes are disposed symmetrically about the peripheral edge of the through hole.

16. The apparatus of claim 9, wherein the apparatus is a centrifugal compressor.

* * * * *